US009741503B2

(12) United States Patent
Chen et al.

(10) Patent No.: US 9,741,503 B2
(45) Date of Patent: Aug. 22, 2017

(54) CONTROL CIRCUIT OF SWITCH DEVICE

(71) Applicant: FSP TECHNOLOGY INC., Taoyuan (TW)

(72) Inventors: Han-Wei Chen, Taoyuan (TW); Chun-Hao Yu, Taoyuan (TW); Chia-Hua Liu, Taoyuan (TW)

(73) Assignee: FSP TECHNOLOGY INC., Taoyuan (TW)

( * ) Notice: Subject to any disclaimer, the term of this patent is extended or adjusted under 35 U.S.C. 154(b) by 332 days.

(21) Appl. No.: 14/623,470

(22) Filed: Feb. 16, 2015

(65) Prior Publication Data

US 2015/0243455 A1 Aug. 27, 2015

Related U.S. Application Data

(60) Provisional application No. 61/944,587, filed on Feb. 26, 2014.

(30) Foreign Application Priority Data

Jan. 23, 2015 (CN) ..... 2015 1 0034255

(51) Int. Cl.
*H01H 9/54* (2006.01)
*H01H 47/22* (2006.01)

(52) U.S. Cl.
CPC ..... *H01H 9/54* (2013.01); *H01H 47/22* (2013.01); *Y10T 307/747* (2015.04)

(58) Field of Classification Search
CPC .. H01H 9/54; H01H 47/22; H03K 2217/0036; H02J 3/14; Y10T 307/747; Y10T 307/76
USPC ..... 327/108, 109, 110, 111, 112; 307/113
See application file for complete search history.

(56) References Cited

U.S. PATENT DOCUMENTS

2007/0109025 A1* 5/2007 Liu ..... H03K 17/04123 327/63

* cited by examiner

*Primary Examiner* — John Poos
(74) *Attorney, Agent, or Firm* — Jianq Chyun IP Office

(57) ABSTRACT

The invention provides a control circuit of a switch device. A single output pin of the control unit outputs an enable signal to control terminals of two switch units to control an on-state of the two switch units, and adjust a current size of a control current of the on-state of the switch device. One of the switch units after receiving the enable signal for a predetermined time is switched to an off-state, so as to reduce power consumption of the switch device.

11 Claims, 2 Drawing Sheets

CONTROL CIRCUIT OF SWITCH DEVICE

CROSS-REFERENCE TO RELATED APPLICATION

This application claims the priority benefits of U.S. provisional application Ser. No. 61/944,587, filed on Feb. 26, 2014 and China application serial no. 201510034255.4, filed on Jan. 23, 2015. The entirety of each of the above-mentioned patent applications is hereby incorporated by reference herein and made a part of this specification.

BACKGROUND

Field of the Invention

The invention is directed to a control circuit and more particularly, to a control circuit of a switch device.

Description of Related Art

An inverter is a power conversion device, which is commonly used to convert DC input power into AC output power by means of switching a power semiconductor element. In a typical photovoltaic grid-connected system, a relay and an electromagnetic interference (EMI) filter is disposed between an inverter and an electrical grid. The relay may separate the inverter from the electrical grid to prevent the inverter from being damaged due to the electrical grid recharging an inrush current to the inverter.

Although the relay can effectively separate the inverter from the electrical grid, the relay needs to be turned on by using a larger-size current. In the current technique, a fixed large current is provided to turn on the relay, but the relay after being turned on actually can be maintained in the on state by using a small current to, which causes unnecessary power consumption.

SUMMARY

The invention provides a control circuit of a switch device capable of reducing power consumption of the switch device.

According to an embodiment, the invention is directed to a control circuit of a switch device including a first switch unit, a second switch unit and a control unit. First terminals of the first switch unit and the second switch unit are coupled to the switch device, and second terminals of the first switch unit and the second switch unit are coupled to the ground. The control unit has an output pin coupled to control terminals of the first switch unit and the second switch unit, outputs an enable signal to the control terminals of the first switch unit and the second switch unit from the output pin to turn on the first switch unit and the second switch unit and generates a control current on a common contact of the first switch unit and the second switch unit. The control current is configured to control an on-state of the switch device, and the first switch unit is switched to an off-state after receiving the enable signal for a predetermined time.

In an embodiment of the invention, the first switch unit and the second switch unit respectively provide a first current path and a second current path when being in the on-state, the control current provides a first current and a second current respectively flowing to the first current path and the second current path to turn on the switch device, wherein a current size of the first current is greater than a current size of the second current.

In an embodiment of the invention, when the first switch unit is switched to the off-state, the control current provides the second current flowing to the second current path to maintain the switch device in the on-state.

In an embodiment of the invention, the first switch unit includes a transistor and a capacitor unit. The transistor is coupled between the switch device and the ground. The capacitor unit is coupled between a control terminal of the transistor and the output pin.

In an embodiment of the invention, the first switch unit further includes a discharge unit coupled between the control terminal of the transistor and the ground.

In an embodiment of the invention, the discharge unit includes a diode having a cathode and an anode respectively coupled to the control terminal of the transistor and the ground.

In an embodiment of the invention, the first switch unit further includes a resistor coupled between the control terminal of the transistor and the capacitor unit.

In an embodiment of the invention, the second switch unit includes a current limiting unit and a transistor. The current limiting unit is coupled to the switch device. The transistor is coupled between the current limiting unit and the ground, and a control terminal of the transistor is coupled to the output pin.

In an embodiment of the invention, the current limiting unit is a resistor.

In an embodiment of the invention, the second switch unit further includes a resistor coupled between the control terminal of the transistor and the output pin.

In an embodiment of the invention, the switch device is a relay.

To sum up, in the invention, the control unit outputs the enable signal from the output pin thereof to the control terminals of the first switch unit and the second switch unit to generate the control current on the common contact of the first switch unit and the second switch unit. The control current is configured to control the on-state of the switch device, the first switch unit is switched to the off-state after receiving the enable signal form the predetermined time, and thereby, power consumption of the switch device can be reduced.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
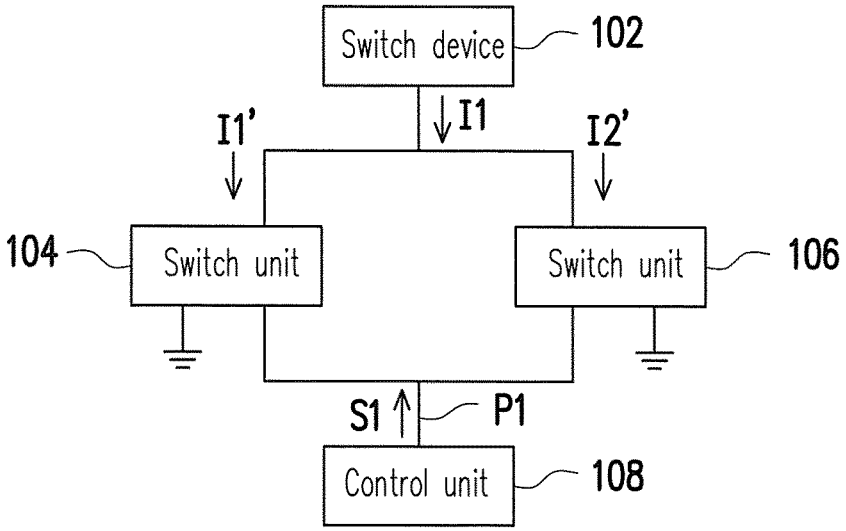
FIG. 1 is a schematic diagram illustrating a control circuit of a switch device according to an embodiment of the invention.

FIG. 1 is a schematic diagram illustrating a control circuit of a switch device according to an embodiment of the invention. Referring to FIG. 1, a control circuit of a switch device 102 includes a switch unit 104, a switch unit 106 and a control unit 108. The switch device 102 may be, for example, a relay. First terminals of the switch unit 104 and switch unit 106 are coupled to the switch device 102, and second terminals of the switch unit 104 and switch unit 106 are coupled to the ground. The control unit 108 has an output pin P1 coupled to control terminals of the switch unit 104 and switch unit 106.

The control unit 108 outputs an enable signal S1 from the output pin P1 thereof to the control terminals of the switch unit 104 and switch unit 106 to turn on the switch unit 104 and the switch unit 106, and generates a control current I1 on a common contact (i.e., a common contact of the first terminals of the switch unit 104 and switch unit 106) of the switch unit 104 and switch unit 106 to control an on-state of the switch device 102. The switch unit 104 and switch unit 106 respectively provide a first current path and a second current path when being in the on-state, such that the control current I1 provides a current and a current I2' respectively flowing to the first current path and the second current path, i.e., the control current I1 is the sum of the current I1' and the current I2'. In some embodiments, a current size of the current I1' may be greater than a current size of the current I2'. It should be noted that the switch unit 104 is switched to an off-state after receiving the enable signal S1 for a predetermined time. Namely, only the switch unit 106 remains providing the second current path, a current size of the control current I1 is equal to the current size of the current I2', which leads to the current size of the control current I1 becoming smaller. The switch device 102 is turned on when the switch unit 104 and switch unit 106 are in the on-state, and even though the switch unit 104 is switched to the off-state after the switch device 102 is turned on, the current I2' provided by the switch unit 106 may still maintain the switch device 102 in the on-state. Thereby, power consumption may be effectively reduced without affecting the operation of the switch device 102.

Figure 2:
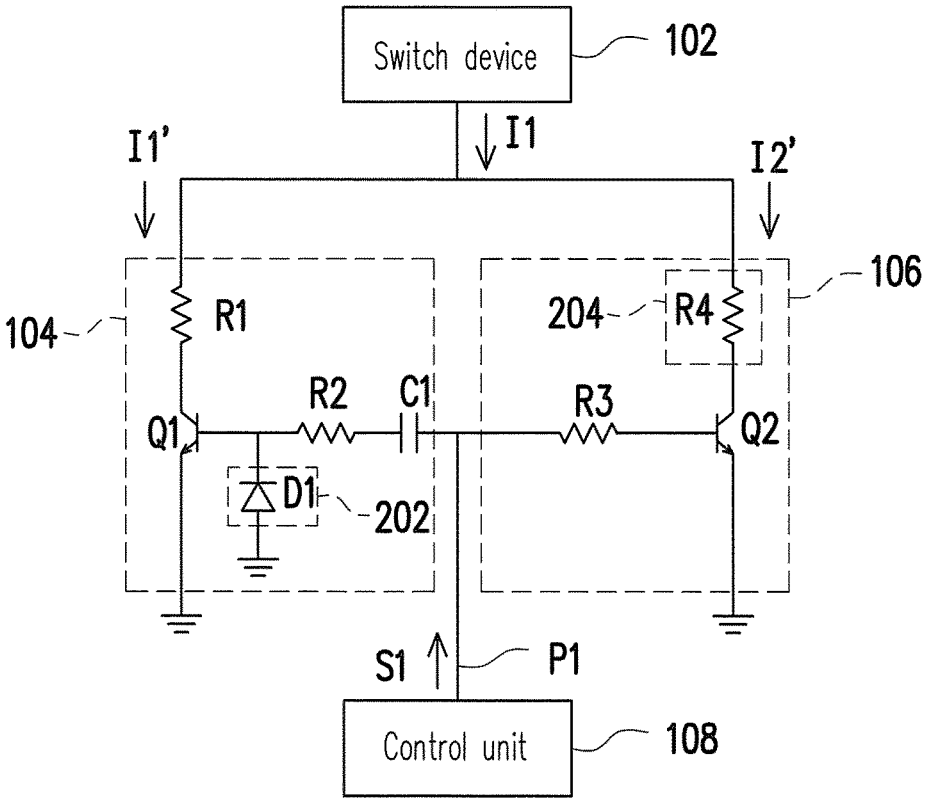
FIG. 2 is a schematic diagram illustrating a control circuit of a switch device according to another embodiment of the invention.

FIG. 2 is a schematic diagram illustrating a control circuit of a switch device according to another embodiment of the invention. Referring to FIG. 2, in the present embodiment, the switch unit 104 includes a resistor R1, a resistor R2, a capacitor unit C1, a transistor Q1 and a discharge unit 202. The resistor R1 is coupled between the switch device 102 and a collector of the transistor Q1, the transistor Q1 is coupled between the resistor R1 and the ground, the resistor R2 and the capacitor unit C1 are connected in serial between a control terminal (i.e., a base) of the transistor Q1 and the output pin P1 of the control unit 108, the discharge unit 202 is coupled between the control terminal of the transistor Q1 and the ground. The discharge unit 202 is implemented by using a diode D1 in the present embodiment. A cathode and an anode of the diode D1 are respectively coupled to the control terminal of the transistor Q1 and the ground.

Additionally, in the present embodiment, the switch unit 106 includes a resistor R3, a transistor Q2 and a current limiting unit 204. The current limiting unit 204 is coupled between the switch device 102 and a collector of the transistor Q2. In the present embodiment, the current limiting unit 204 is implemented by using a resistor R4. The resistor R4 is coupled between switch device 102 and the collector of the transistor Q2. In another embodiment, the current limiting unit 204 may be implemented in any other form, e.g., by using resistors connected in serial or in parallel. An emitter of the transistor Q2 is coupled to the ground, a control terminal (i.e., a base) of the transistor Q2 is coupled to one end of the resistor R3, and the other end of the resistor R3 is coupled to the control unit 108. In some embodiments, the switch unit 104 may also not include the resistor R1, the resistor R2, while the switch unit 106 may also not include the resistor R3. Namely, the collector and the control terminal of the transistor Q1 may be respectively coupled to the switch device 102 and the capacitor unit C1 directly, and the control terminal transistor Q2 may be directly coupled to the control unit 108.

When the switch device 102 is to be turned on, the control unit 108 outputs the enable signal S1 to the bases of the transistor Q1 and the transistor Q2. In the present embodiment, the enable signal S1 is a current signal. The enable signal S1 may serve to turn on the transistor Q1 and the transistor Q2 to generate the control current I1 on the common contact of the switch unit 104 and switch unit 106, so as to turn on the switch device 102. The capacitor unit C1 is gradually and fully charged by a current flowing thereto. After the predetermined time, the capacitor unit C1 presents in an open-circuit state, and thus, the transistor Q1 is turned off and incapable of continuously providing the current I1', such that the control current I1 becomes smaller. On the other hand, since the current provided by the control unit 108 is continuously output to the base of the transistor Q2, the transistor Q2 is still capable of providing the current I2', such that the switch device 102 is maintained in the on state. The current size of the current I2' may be adjusted through the current limiting unit 204. For example, in the present embodiment, as resistance of the resistor R4 is increased, the current size of the current I2' is decreased.

In this way, the switch device 102 (e.g., a relay) may be turned on by means of the control circuit providing a large-size control current I1 (which is equal to I1'+I2') at the beginning, and after the switch device 102 is turned, a small-size control current I1 (which is equal I2') may continue to be provided to maintain the on-state of the switch device 102 to reduce the power consumption. Besides, in the embodiments of the invention, only one single output pin P1 can achieve the control of the on-state of the switch unit 104 and switch unit 106, so as to change the current size of the control current I1.

Figure 3:
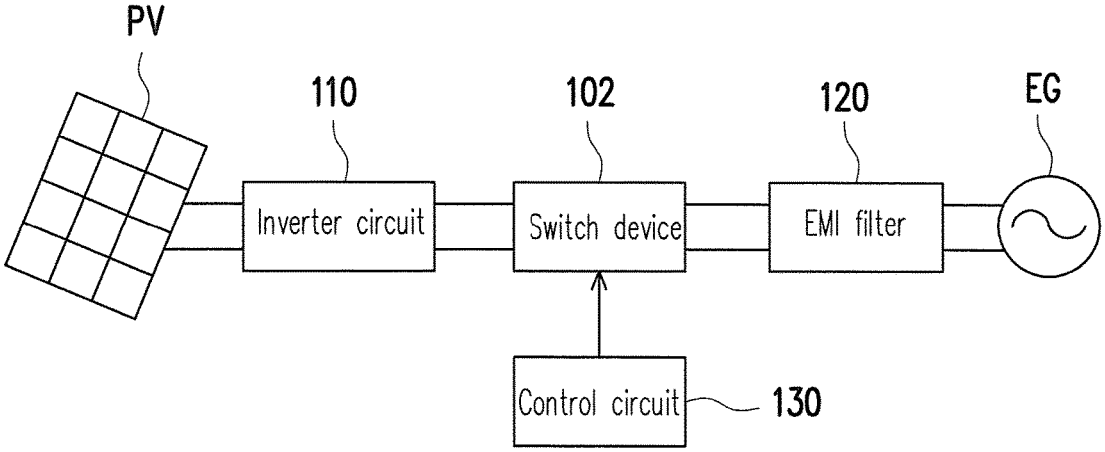
FIG. 3 is a schematic diagram illustrating the control circuit of the switch device applied in a photovoltaic grid-connected system according to an embodiment of the invention.

The application of the control circuit of the switch device may be illustrated in FIG. 3, for example. FIG. 3 is a schematic diagram illustrating the control circuit of the switch device applied in a photovoltaic grid-connected system according to an embodiment of the invention. Referring to FIG. 3, a photovoltaic grid-connected system includes a photovoltaic element PV, the switch device 102, inverter circuit 110, an EMI filter 120, the control circuit 130 and an electrical grid EG. The inverter circuit 110 is coupled to the photovoltaic element PV and the switch device 102, the control circuit 130 is coupled to the switch device 102, and the EMI filter 120 is coupled to the switch device 102 and the electrical grid EG.

The photovoltaic element PV reacts to solar intensity to output a DC voltage the inverter circuit 110, such that the inverter circuit 110 converts the DC voltage in to an AC voltage, which is output to the back-end electrical grid EG for use, and the EMI filter 120 is disposed between the inverter circuit 110 and the electrical grid EG and configured to suppress EMI noise of the AC voltage. Additionally, the switch device 102 is controlled by the control circuit 130 and its on-state is changed, such that the inverter circuit 110 is separated from the electrical grid EG. In the present embodiment, the switch device 102 is a relay. The control circuit 130 may be implemented in the same way as in the embodiments above and thus, will not be repeatedly described. Controlling the on-state of the switch device 102 through the control circuit 130 can facilitated in not only effectively separating the inverter circuit from the electrical grid to prevent the inverter from being damaged due to the electrical grid recharging an inrush current to the inverter, but also maintaining the switch device 102 after being turned on in the on-state by using a small current to reduce unnecessary power consumption.

To summarize, the invention achieves the control of the on-state of the switch devices by means of the single output pin of the control unit outputting the enable signal output to the control terminals of the two switch units, so as to adjust the size of the control current for controlling the on-state, where one of the switch units is switched to the off-state after receiving the enable signal for a predetermined time to reduce the power consumption of the switch device.

What is claimed is:

1. A control circuit of a switch device, comprising:

a first switch unit;

a second switch unit, wherein a first terminal of the first switch unit and a first terminal of the second switch unit are coupled to the switch device, and a second terminal of the first switch unit and a second terminal of the second switch unit are coupled to the ground; and a control unit, having an output pin coupled with a control terminal of the first switch unit and a control terminal of the second switch unit, outputting an enable signal to the control terminals of the first switch unit and the second switch unit from the output pin to simultaneously turn on the first switch unit and the second switch unit, and generating a control current on a common contact of the first switch unit and the second switch unit, wherein the control current is configured to control an on-state of the switch device, and the first switch unit is switched to an off-state after receiving the enable signal for a predetermined time.

2. The control circuit of the switch device according to claim 1, wherein the first switch unit and the second switch unit respectively provide a first current path and a second current path when being in the on-state, and the control current provides a first current and a second current respectively flowing to the first current path and the second current path to turn on the switch device, wherein a current size of the first current is greater than a current size of the second current.

3. The control circuit of the switch device according to claim 2, wherein when the first switch unit is switched to the off-state, the control current provides the second current flowing to the second current path to maintain the switch device in the on-state.

4. The control circuit of the switch device according to claim 1, wherein the first switch unit comprises:

a transistor, coupled between the switch device and the ground; and a capacitor unit, coupled between a control terminal of the transistor and the output pin.

5. The control circuit of the switch device according to claim 4, wherein the first switch unit further comprises:

a discharge unit, coupled between the control terminal of the transistor and the ground.

6. The control circuit of the switch device according to claim 5, wherein the discharge unit comprises:

a diode, having a cathode and an anode respectively coupled to the control terminal of the transistor and the ground.

7. The control circuit of the switch device according to claim 4, wherein the first switch unit further comprises:

a resistor, coupled between the control terminal of the transistor and the capacitor unit.

8. The control circuit of the switch device according to claim 1, wherein the second switch unit comprises:

a current limiting unit, coupled to the switch device; and a transistor, coupled between the current limiting unit and the ground and having a control terminal coupled to the output pin.

9. The control circuit of the switch device according to claim 8, wherein the current limiting unit is a resistor.

10. The control circuit of the switch device according to claim 8, wherein the second switch unit further comprises:

a resistor, coupled between the control terminal of the transistor and the output pin.

11. The control circuit of the switch device according to claim 1, wherein the switch device is a relay.

* * * * *